US011034546B2

(12) United States Patent
Kwon et al.

(10) Patent No.: US 11,034,546 B2
(45) Date of Patent: Jun. 15, 2021

(54) ELEVATOR GOVERNOR

(71) Applicant: OTIS ELEVATOR COMPANY, Farmington, CT (US)

(72) Inventors: YiSug Kwon, Farmington, CT (US); Randall S. Dube, Glastonbury, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 334 days.

(21) Appl. No.: 16/021,398

(22) Filed: Jun. 28, 2018

(65) Prior Publication Data

US 2020/0002128 A1 Jan. 2, 2020

(51) Int. Cl.
*B66B 5/04* (2006.01)
*B66B 5/18* (2006.01)

(52) U.S. Cl.
CPC ..... *B66B 5/044* (2013.01); *B66B 5/18* (2013.01)

(58) Field of Classification Search
CPC ..... B66B 5/044; B66B 5/18
See application file for complete search history.

(56) References Cited

U.S. PATENT DOCUMENTS 3,327,811 A * 6/1967 Mastroberte ..... B66B 5/044 187/305
4,556,155 A * 12/1985 Koppensteiner ..... B66B 5/044 187/305
5,310,022 A * 5/1994 Sheridan ..... B66B 5/044 187/305
5,653,312 A * 8/1997 Kato ..... B66D 5/16 187/350
8,069,956 B2 * 12/2011 Okada ..... B66B 5/044 187/287
8,136,795 B2 * 3/2012 Dube ..... B66B 5/044 254/394
8,931,598 B2 1/2015 Aguado et al.
(Continued)

FOREIGN PATENT DOCUMENTS

CN 201211988 Y 3/2009
EP 1798183 6/2007
(Continued)

OTHER PUBLICATIONS

The Extended European Search Report for EP Application No. 19183394.6, dated Jan. 8, 2020.

*Primary Examiner* — Michael A Riegelman
(74) *Attorney, Agent, or Firm* — Carlson, Gaskey & Olds

(57) ABSTRACT

An illustrative example elevator governor includes at least one flyweight configured to move a first distance between an initial position corresponding to a zero speed condition and an activation position corresponding to an elevator speed that reaches a predefined threshold. A biasing member biases the at least one flyweight toward the initial position. The biasing member is configured to allow the at least one flyweight to reach the activation position when the elevator speed reaches the predefined threshold. A flyweight position member sets a rest position of the at least one flyweight in the zero speed condition that is between the initial position and the activation position. A range of motion of the at least one flyweight is limited to a second, shorter distance between the rest position and the activation position.

17 Claims, 3 Drawing Sheets

(56) References Cited

U.S. PATENT DOCUMENTS

| | | | | |
|---|---|---|---|---|
| 8,950,554 | B2 * | 2/2015 | Niikawa | B66B 5/044 187/305 |
| 2003/0042079 | A1 * | 3/2003 | Sanchez | B66B 5/044 187/373 |
| 2010/0059319 | A1 * | 3/2010 | Aguado | B66B 5/044 187/414 |
| 2012/0312638 | A1 * | 12/2012 | Muller | B66B 5/044 187/287 |
| 2017/0190545 | A1 * | 7/2017 | Dube | B66B 5/044 |
| 2018/0118515 | A1 * | 5/2018 | Shi | B66B 5/044 |
| 2019/0202664 | A1 * | 7/2019 | Geng | B66B 5/048 |
| 2020/0002128 | A1 * | 1/2020 | Kwon | B66B 5/044 |
| 2020/0024106 | A1 * | 1/2020 | Dube | B66B 5/044 |

FOREIGN PATENT DOCUMENTS

| | | | |
|---|---|---|---|
| EP | 2380840 | A1 | 10/2011 |
| EP | 2602222 | A1 | 6/2013 |
| EP | 2617672 | A1 | 7/2013 |
| JP | 2002107368 | A | 4/2002 |
| JP | 2002370879 | A | 12/2002 |
| JP | 2016016935 | A | 2/2016 |
| WO | 2006/033252 | A1 | 3/2006 |
| WO | 2008079106 | | 7/2008 |

* cited by examiner

ELEVATOR GOVERNOR

BACKGROUND

Elevator systems are in widespread use for carrying passengers between various levels in buildings, for example. Various types of elevator systems are known.

One of the features of an elevator system provides protection against over speed conditions. Elevator systems typically include an over speed governor that operates in response to the elevator car moving at a speed above a predetermined threshold speed. In such situations, the governor instigates a brake application by activating a switch or moving a linkage mechanism.

The configuration of some low-to-midrise, light weight elevators may allow for a natural or resonant frequency associated with the system rise, moving masses, suspension termination stiffness, and the roping that supports the elevator car. In some such systems, it is possible for a passenger in the elevator car to bounce or jump in a manner that induces vertical oscillations of the elevator car. When those oscillations are at or near the natural frequency of the system, the elevator car may bounce sufficiently to activate the over speed governor resulting in an emergency stop of the elevator car. Stopping the car this way interferes with the availability of the elevator car to provide service to other passengers. Additionally, such stops often require a mechanic to visit the site to allow passengers to exit the car, to reset the governor over speed switch and may require the safeties to be reset before placing the elevator car back into service.

SUMMARY

An illustrative example elevator governor includes at least one flyweight configured to move a first distance between an initial position corresponding to a zero speed condition and an activation position corresponding to an elevator speed that reaches a predefined threshold. A biasing member biases the at least one flyweight toward the initial position. The biasing member is configured to allow the at least one flyweight to reach the activation position when the elevator speed reaches the predefined threshold. A flyweight position member sets a rest position of the at least one flyweight in the zero speed condition that is between the initial position and the activation position. A range of motion of the at least one flyweight is limited to a second, shorter distance between the rest position and the activation position.

An example embodiment having one or more features of the elevator governor of the previous paragraph includes a sheave that is configured to move at a governor speed corresponding to the elevator speed. The at least one flyweight is supported on the sheave for movement with the sheave and for movement relative to the sheave within the range of motion.

In an example embodiment having one or more features of the elevator governor of any of the previous paragraphs, the flyweight position member is secured to the sheave.

In an example embodiment having one or more features of the elevator governor of any of the previous paragraphs, the flyweight position member is formed as part of the sheave.

In an example embodiment having one or more features of the elevator governor of any of the previous paragraphs, the flyweight position member is supported on the at least one flyweight.

In an example embodiment having one or more features of the elevator governor of any of the previous paragraphs, the at least one flyweight remains in the rest position within a first range of elevator speeds between the zero speed condition and an intermediate elevator speed below the predefined threshold. The at least one flyweight moves against a bias of the biasing member between the rest position and the activation position within a second range of elevator speeds between the intermediate elevator speed and the predefined threshold.

In an example embodiment having one or more features of the elevator governor of any of the previous paragraphs, the biasing member comprises a spring having a spring constant and a length to induce tension that is selected to resist movement of the at least one flyweight from the initial position to the activation position in a manner that allows the at least one flyweight to reach the activation position if the elevator speed reaches the defined threshold.

In an example embodiment having one or more features of the elevator governor of any of the previous paragraphs, the spring has a first length corresponding to the at least one flyweight being in the initial position, the first length corresponds to a first induced tension, the spring is stretched to a second length when the at least one flyweight is in the rest position, the second length is longer than the first length, the second length corresponds to a second induced tension that is higher than the first induced tension, the spring is stretched further to a third length when the at least one flyweight is in the activation position, and the third length is longer than the second length.

In an example embodiment having one or more features of the elevator governor of any of the previous paragraphs, the at least one flyweight comprises a plurality of flyweights and the flyweight position member comprises a corresponding plurality of position members that prevent the respective flyweights from moving from the rest position toward the initial position.

In an example embodiment having one or more features of the elevator governor of any of the previous paragraphs, the flyweight position member establishes the rest position where the biasing member resists movement of the at least one flyweight during movement of an associated elevator car within a selected frequency range.

In an example embodiment having one or more features of the elevator governor of any of the previous paragraphs, the initial position is at a first radial distance from a center of rotation of the governor, the rest position is at a second radial distance from the center of rotation, the second radial distance is larger than the first radial distance, the activation position is at a third radial distance from the center of rotation, and the third radial distance is larger than the second radial distance.

An illustrative example embodiment of an elevator governor includes at least one flyweight configured to move into an activation position in response to an elevator speed reaching a predefined threshold speed. A spring biases the at least one flyweight away from the activation position. The spring has a spring constant and an initial length configured to control movement of the at least one flyweight into the activation position. The spring is set to a second, longer length in a zero speed condition. The at least one flyweight remains in a rest position corresponding to the second, longer length within a first range of elevator speeds between the zero speed condition and an intermediate elevator speed below the predefined threshold speed. The spring is elongated to a third length that is longer than the second length as the at least one flyweight moves against a bias of the spring between the rest position and the activation position within a second range of elevator speeds between the intermediate elevator speed and the predefined threshold speed.

In an example embodiment having one or more features of the elevator governor of the previous paragraph, the spring is configured to allow the at least one flyweight to reach the activation position when the elevator speed reaches the predefined threshold speed.

An example embodiment having one or more features of the elevator governor of either of the two previous paragraphs includes a flyweight position member that sets a rest position of the at least one flyweight in the zero speed condition. The rest position corresponds to the second length of the spring.

In an example embodiment having one or more features of the elevator governor of any of the previous paragraphs, movement of the at least one flyweight is limited to a range of motion between the rest position and the activation position. The range of motion corresponds to spring lengths between the second length and the third length.

In an example embodiment having one or more features of the elevator governor of any of the previous paragraphs, the flyweight position member is supported on the at least one flyweight.

In an example embodiment having one or more features of the elevator governor of any of the previous paragraphs, the at least one flyweight comprises a plurality of flyweights, the spring comprises a corresponding plurality of springs, and each of the springs is coupled with a respective one of the flyweights.

In an example embodiment having one or more features of the elevator governor of any of the previous paragraphs, the flyweight position member establishes the rest position where the spring resists movement of the at least one flyweight during movement of an associated elevator car within a selected frequency range.

In an example embodiment having one or more features of the elevator governor of any of the previous paragraphs, the initial length of the spring corresponds to the at least one flyweight being situated at a first radial distance from a center of rotation of the governor, the second length of the spring corresponds to the at least one flyweight being situated at a second radial distance from the center of rotation, the second radial distance is larger than the first radial distance, the third length of the spring corresponds to the at least one flyweight being situated at a third radial distance from the center of rotation, and the third radial distance is larger than the second radial distance.

The various features and advantages of at least one example embodiment will become apparent to those skilled in the art from the following detailed description. The drawings that accompany the detailed description can be briefly described as follows.

DETAILED DESCRIPTION

Embodiments of this invention provide an elevator governor that has a more consistent activation speed and is less sensitive to unusual movement of an elevator car, such as oscillations or vibrations that may be caused by a passenger bouncing in the elevator car.

Figure 1:
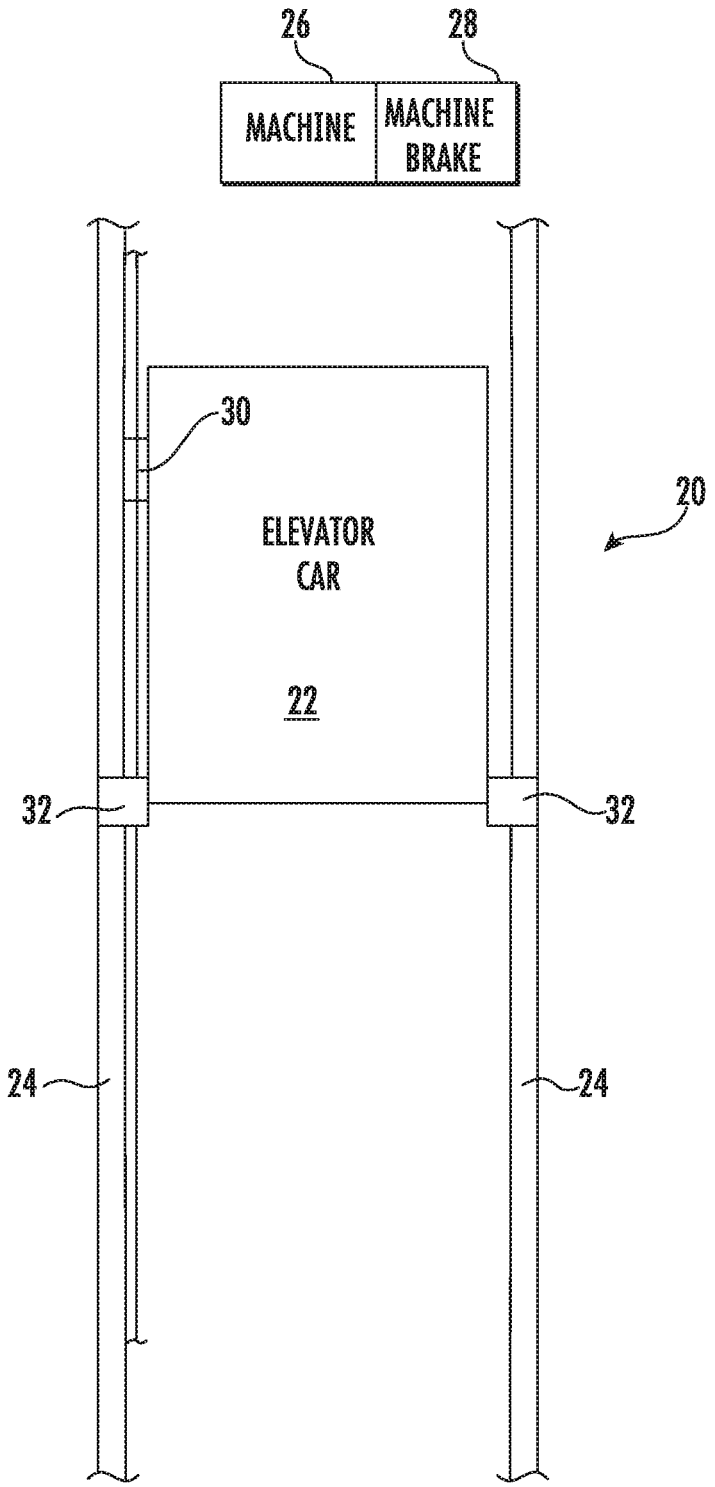
FIG. 1 schematically illustrates selected portions of an elevator system including a governor designed according to an embodiment of this invention.

FIG. 1 schematically illustrates selected portions of an elevator system 20. An elevator car 22 is situated to move along guiderails 24 based on operation of a machine 26 and machine brake 28, which occurs in a generally known manner. A governor 30 is associated with the elevator car or otherwise positioned within the hoistway so that the governor 30 operates based upon a speed of movement of the elevator car 22. The governor 30 instigates application of safety brakes 32 to bring the elevator car 22 to a stop in the event that the elevator speed exceeds a predefined threshold.

Figure 2:
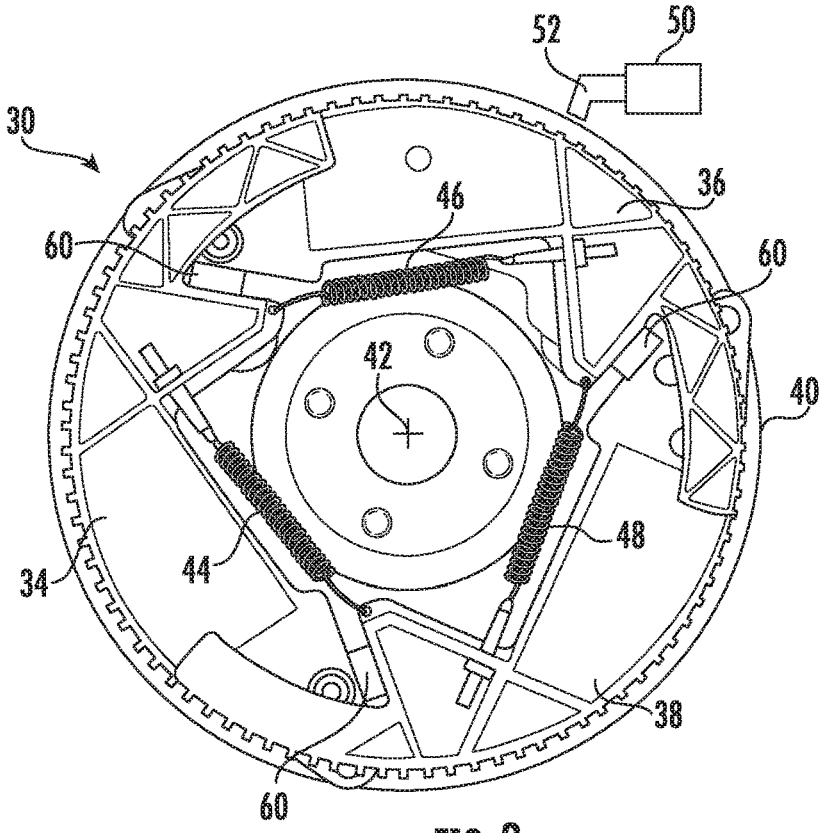
FIG. 2 diagrammatically illustrates a governor device designed according to an embodiment of this invention.

FIG. 2 illustrates an example embodiment of a governor 30. A plurality of flyweights 34, 36 and 38 are supported on a sheave 40 to rotate with the sheave 40 about a central axis of rotation 42 as the elevator car 22 moves vertically along the guiderails 24. The flyweights 34, 36 and 38 are configured to move radially outward in increasing amounts responsive to increasing elevator speeds.

A plurality of springs 44, 46 and 48 are respectively coupled with the flyweights 34, 36 and 38. The springs 44, 46 and 48 are biasing members that bias the flyweights 34, 36 and 38, respectively, radially inward and resist radially outward motion of the flyweights to control the respective positions of the flyweights at different elevator speeds.

The springs 44, 46 and 48 have a selected spring constant and initial length inducing a tension that, combined with the configuration of the flyweights 34, 36 and 38, control the radial movement of the flyweights to move into an activation position where at least one of the flyweights activates a switch 50 by making contact with a switch contact 52 that changes an electrical state of the switch 50 when the elevator speed reaches a preselected or predefined threshold speed. The switch 50 operates to instigate a brake application of the machine brake 28 to bring the elevator car 22 to a stop if the elevator car speed reaches the threshold.

While the example of FIG. 2 includes switch activation to instigate application of a machine brake, other embodiments include the governor 30 activating a mechanical linkage to instigate application of the safeties 32.

The governor 30 includes a plurality of flyweight position members 60 that set or define a rest position of the respective flyweights 34, 36 and 38. Under zero speed conditions, the flyweights 34, 36 and 38 are in the rest position defined, at least in part, by the flyweight position members 60. The flyweights 34, 36 and 38 remain in the rest position during a first range of elevator speeds between the zero speed condition and an intermediate speed that is less than the predefined threshold. The flyweights 34, 36 and 38 move against the bias of the respective springs 44, 46 and 48 toward the activation position when the elevator speed is in a second range between the intermediate speed and the predefined threshold speed. Maintaining the flyweights 34, 36 and 38 in a rest position set or at least partially defined by the flyweight position members 60 increases the stability of the governor 30 and avoids false actuation scenarios in which the flyweights 34, 36 and 38 may otherwise move into the activation position responsive to abnormal passenger behavior (APB) that causes bouncing or vertical oscillations of the elevator car 22.

For example, APB that includes bouncing in the elevator car 22 may induce vibrations or oscillations of the elevator car 22 that could cause the flyweights 34, 36, 38 to move outward into the activation position actuating the switch contact 52 as if the elevator car 22 was moving at a speed above the predefined threshold speed. In some elevator systems APB in a frequency range of 2.5 Hz to 5 Hz can cause enough movement of the flyweights 34, 36 and 38 to reach the activation position and contact the switch contact 52. With flyweight position members 60, the governor 30 is more stable and the flyweights 34, 36, 38 remain in or very near the rest position even during APB conditions, which minimizes or avoids false actuation of the switch 50. The flyweight position members 60 and the way in which the flyweights 34, 36 and 38 are situated in the rest position effectively prevents false actuations and ensures that the flyweights 34, 36 and 38 only reach the activation position when the elevator car 22 has actually exceeded the predefined threshold speed.

Figure 3:
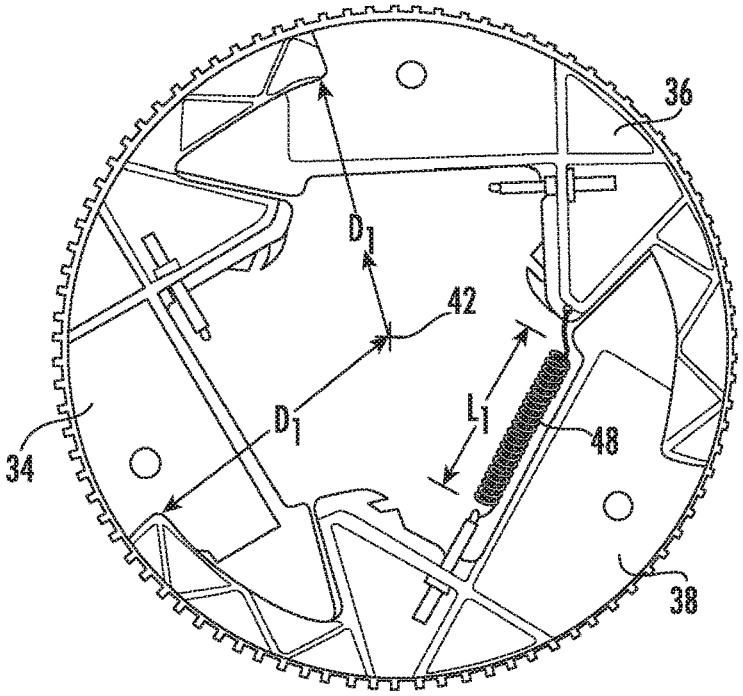
FIG. 3 shows selected portions of the embodiment of FIG. 2 in one condition.

FIG. 3 illustrates selected portions of the governor 30 including the flyweights 34, 36 and 38 and the spring 48. As can be appreciated from FIG. 3, respective reference locations on the flyweights 34, 36 and 38 are at a first distance $D_1$ from the axis of rotation 42. The position of the flyweights 34, 36 and 38 shown in FIG. 3 corresponds to the springs having an initial length $L_1$. The initial length of the springs 44, 46 and 48 is a design length that induces a first tension and, together with the spring constant, controls movement of the flyweights in response to rotation of the governor 30 so that the flyweights reach the activation position at a desired or designed threshold speed. The position shown in FIG. 3 corresponds to an arrangement of the flyweights 34, 36 and 38 relative to the axis of rotation 42 if there were no flyweight position members 60 provided on the governor 30. The position shown in FIG. 3 including the first radial distance $D_1$, the initial spring length $L_1$ and the first induced tension is referred to as an initial position within this description.

Figure 4:
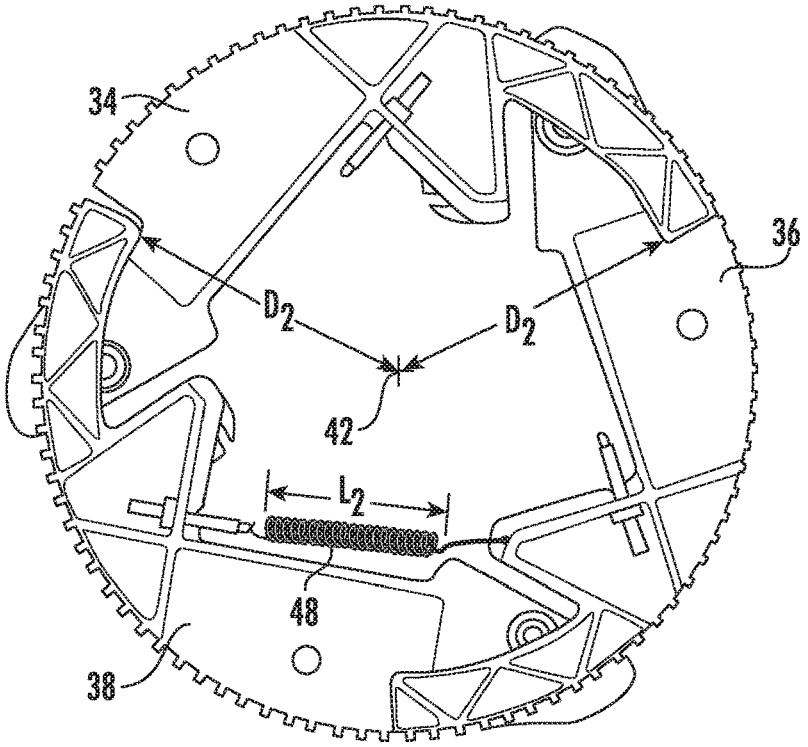
FIG. 4 shows the features of FIG. 3 in another condition.

FIG. 4 illustrates the position or arrangement of the flyweights 34, 36 and 38 relative to the axis of rotation 42 with the flyweight position members 60 in place. The flyweight position members 60 are not illustrated in FIG. 4 to simplify the illustration. The flyweights 34, 36 and 38 are in a rest position in FIG. 4 with a second radial distance $D_2$ between the reference location on each flyweight and the axis of rotation 42. The second radial distance $D_2$ is larger than the first radial distance $D_1$ shown in FIG. 3.

With the flyweights 34, 36 and 38 in the rest position shown in FIG. 4 (and FIG. 2), the spring length of the spring 48 (and the springs 44 and 46 not specifically illustrated in FIG. 4) is a second length $L_2$. With the flyweights 34, 36 and 38 in the rest position, the respective springs are partially stretched or elongated beyond the initial length $L_1$ to the second, longer length $L_2$. With the springs at this second length, a second tension is induced and the springs provide a bias that maintains the respective flyweights in the rest position during the first range of elevator speeds (e.g., between zero and an intermediate speed). The second induced tension is higher than the first induced tension.

Figure 5:
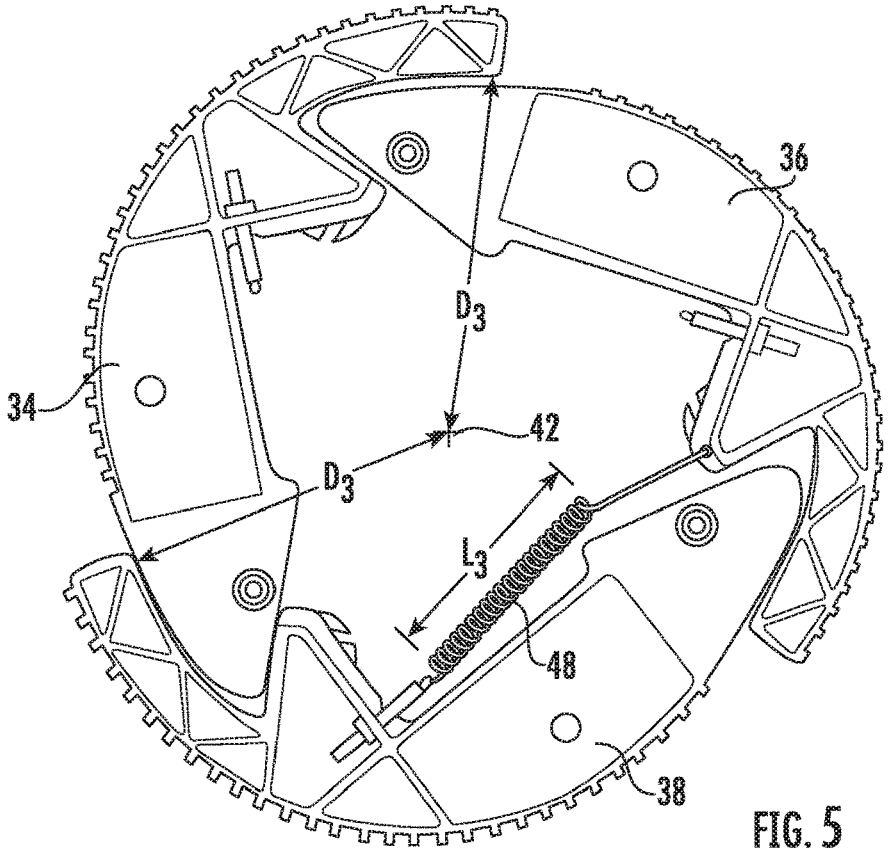
FIG. 5 shows the features of FIGS. 2 and 3 in another condition.

When the elevator speed exceeds the intermediate speed and approaches the predefined threshold speed, the flyweights 34, 36 and 38 move against the bias of the respective springs into the activation position represented in FIG. 5. In the activation position, the reference location on the respective flyweights is situated at a third radial distance $D_3$ from the axis of rotation 42. The third radial distance $D_3$ is greater than the second radial distance $D_2$. In the activation position, the respective springs are elongated or stretched to a third length $L_3$, which is greater than the second length $L_2$. Only the spring 48 is shown in FIG. 5, although those skilled in the art will understand how all of the springs in the example embodiment would be similarly elongated to the third length $L_3$.

The flyweight position members 60 limit a range of motion of the flyweights 34, 36 and 38 to a distance that is the difference between $D_3$ and $D_2$. That range of motion is over a shorter distance than the difference between $D_3$ and $D_1$. Similarly, the range of elongation or stretch of the springs 44, 46 and 48 is limited to the difference between $L_3$ and $L_2$ rather than the longer difference between $L_3$ and $L_1$. Maintaining the flyweights 34, 36 and 38 stationary in the rest position over the first range of elevator speeds even though the combination of the flyweights and springs is designed or initially selected to allow for movement between an initial position and the rest position enhances the stability and consistency of governor operation.

Having the springs 44, 46 and 48 pre-stretched to the second length $L_2$ corresponding to the second induced tension and the flyweights 34, 36 and 38 held in the rest position defined, at least in part, by the flyweight position members 60 reduces or eliminates the resonance of the governor 30 that otherwise may react to APB causing bouncing or vertical oscillations of the elevator car 22. The flyweight position members 60 effectively make the springs 44, 46 and 48 unresponsive to such oscillations of the elevator car 22. At the same time, the springs 44, 46 and 48 and the respective flyweights 34, 36 and 38 are able to respond to elevator speeds approaching the predefined threshold speed so that the governor 30 operates as intended to instigate machine brake activation in the event of an elevator over speed condition.

In some example embodiments the flyweight position members 60 are secured to a portion of the sheave 40 of the governor 30. Some embodiments include flyweight position members 60 that are formed as part of the respective flyweights 34, 36 and 38. In other example embodiments, the flyweight position members 60 are secured to the flyweights 34, 36 and 38, respectively.

The flyweight position members 60 may take a variety of forms. One example embodiment includes generally rectangular-shaped stoppers. Another example embodiment includes generally cylindrically shaped stoppers. The flyweight position members 60 in such embodiments are made from a rigid material, such as plastic. The flyweight position members 60 in different embodiments have different geometries and are made of different materials. The material selected for a particular embodiment has sufficient rigidity while not introducing an appreciable amount of mass so that the flyweight position members 60 do not interfere with the intended centrifugal operation of the governor 30.

Including the flyweight position members 60 and situating the flyweights 34, 36 and 38 in a rest position between an initial position and activation position for a first range of elevator speeds between a zero speed condition and an intermediate speed below the threshold governor activation speed, facilitates achieving more reliable governor operation and avoids governor-instigated brake applications in response to vertical oscillations or bouncing of an elevator car caused by APB, for example.

Governors designed according to an embodiment of this invention will operate in a manner that the flyweights remain stationary in a rest position for a higher percentage of the elevator contract speed before any movement occurs toward the activation position. In some embodiments, the intermediate speed mentioned above is slightly below the threshold speed. Some embodiments include the flyweights 34, 36 and 38 remaining stationary in the rest position until the threshold speed is reached at which time the flyweights move into the activation position to instigate brake application.

The preceding description is exemplary rather than limiting in nature. For example, the number and type of flyweights and the locations of the flyweight position members may differ compared to the illustrated example embodiment. Variations and modifications to the disclosed examples may become apparent to those skilled in the art that do not necessarily depart from the essence of this invention. The scope of legal protection given to this invention can only be determined by studying the following claims.

We claim:

1. An elevator governor, comprising:

at least one flyweight configured to move a first distance between an initial position corresponding to a zero speed condition and an activation position corresponding to an elevator speed that reaches a predefined threshold;

a biasing member that biases the at least one flyweight toward the initial position, the biasing member being configured to allow the at least one flyweight to reach the activation position when the elevator speed reaches the predefined threshold; and a flyweight position member that sets a rest position of the at least one flyweight in a zero speed condition that is between the initial position and the activation position such that a range of motion of the at least one flyweight is limited to a second, shorter distance between the rest position and the activation position, wherein the biasing member comprises a spring having a spring constant selected to resist movement of the at least one flyweight from the initial position to the activation position in a manner that allows the at least one flyweight to reach the activation position if the elevator speed reaches the predefined threshold;

the spring has a first length corresponding to the at least one flyweight being in the initial position;

the first length corresponds to a first induced tension;

the spring is stretched to a second length when the at least one flyweight is in the rest position;

the second length is longer than the first length;

the second length corresponds to a second induced tension;

the second induced tension is higher than the first induced tension;

the spring is stretched further to a third length when the at least one flyweight is in the activation position; and the third length is longer than the second length.

2. The elevator governor of claim 1, comprising a sheave that is configured to move at a governor speed corresponding to the elevator speed and wherein the at least one flyweight is supported on the sheave for movement with the sheave and for movement within the range of motion.

3. The elevator governor of claim 2, wherein the flyweight position member is secured to the sheave.

4. The elevator governor of claim 1, wherein the flyweight position member is formed as part of the flyweight.

5. The elevator governor of claim 1, wherein the flyweight position member is supported on the at least one flyweight.

6. The elevator governor of claim 1, wherein the at least one flyweight remains in the rest position within a first range of elevator speeds between the zero speed condition and an intermediate elevator speed below the predefined threshold; and the at least one flyweight moves against a bias of the biasing member between the rest position and the activation position within a second range of elevator speeds between the intermediate elevator speed and the predefined threshold.

7. The elevator governor of claim 1, wherein the at least one flyweight comprises a plurality of flyweights; and the flyweight position member comprises a corresponding plurality of position members that prevent the respective flyweights from moving from the rest position toward the initial position.

8. The elevator governor of claim 1, wherein the flyweight position member establishes the rest position where the biasing member resists movement of the at least one flyweight during movement of an associated elevator car within a selected frequency range.

9. The elevator governor of claim 1, wherein the initial position is at a first radial distance from a center of rotation of the governor;

the rest position is at a second radial distance from the center of rotation;

the second radial distance is larger than the first radial distance;

the activation position is at a third radial distance from the center of rotation; and the third radial distance is larger than the second radial distance.

10. An elevator governor, comprising:

at least one flyweight configured to move into an activation position in response to an elevator speed reaching a predefined threshold speed; and a spring that biases the at least one flyweight away from the activation position, the spring having a spring constant and an initial length configured to control movement of the at least one flyweight into the activation position, the spring being set to a second, longer length in a zero speed condition, wherein the at least one flyweight remains in a rest position corresponding to the second, longer length within a first range of elevator speeds between the zero speed condition and an intermediate elevator speed below the predefined threshold speed, and wherein the spring is elongated to a third length that is longer than the second length as the at least one flyweight moves against a bias of the spring between the rest position and the activation position within a second range of elevator speeds between the intermediate elevator speed and the predefined threshold speed.

11. The elevator governor of claim 10, wherein the spring is configured to allow the at least one flyweight to reach the activation position when the elevator speed reaches the predefined threshold speed.

12. The elevator governor of claim 10, comprising a flyweight position member that sets a rest position of the at least one flyweight in the zero speed condition, wherein the rest position corresponds to the second length of the spring.

13. The elevator governor of claim 12, wherein movement of the at least one flyweight is limited to a range of motion between the rest position and the activation position; and the range of motion corresponds to spring lengths between the second length and the third length.

14. The elevator governor of claim 12, wherein the flyweight position member is supported on the at least one flyweight.

15. The elevator governor of claim 10, wherein the at least one flyweight comprises a plurality of flyweights;

the spring comprises a corresponding plurality of springs; and each of the springs is coupled with a respective one of the flyweights.

16. The elevator governor of claim 15, wherein the flyweight position member establishes the rest position where the spring resists movement of the at least one flyweight during movement of an associated elevator car within a selected frequency range.

17. The elevator governor of claim 10, wherein the initial length of the spring corresponds to the at least one flyweight being situated at a first radial distance from a center of rotation of the governor;

the second length of the spring corresponds to the at least one flyweight being situated at a second radial distance from the center of rotation;

the second radial distance is larger than the first radial distance;

the third length of the spring corresponds to the at least one flyweight being situated at a third radial distance from the center of rotation; and the third radial distance is larger than the second radial distance.

* * * * *